US010947661B2

(12) United States Patent
Je et al.

(10) Patent No.: US 10,947,661 B2
(45) Date of Patent: Mar. 16, 2021

(54) CONTROL METHOD OF CLOTHES DRYER

(71) Applicant: LG Electronics Inc., Seoul (KR)

(72) Inventors: Haeyoon Je, Seoul (KR); Ingeon Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 258 days.

(21) Appl. No.: 16/196,417

(22) Filed: Nov. 20, 2018

(65) Prior Publication Data

US 2019/0153658 A1 May 23, 2019

(30) Foreign Application Priority Data

Nov. 20, 2017 (KR) ..... 10-2017-0154928

(51) Int. Cl.
*D06F 58/20* (2006.01)
*D06F 25/00* (2006.01)
(Continued)

(52) U.S. Cl.
CPC ..... *D06F 58/206* (2013.01); *D06F 25/00* (2013.01); *D06F 58/30* (2020.02); *D06F 2103/50* (2020.02); *D06F 2105/26* (2020.02)

(58) Field of Classification Search
CPC ..... D06F 58/206; D06F 58/30; D06F 25/00; D06F 2103/50; D06F 2105/26;
(Continued)

(56) References Cited

U.S. PATENT DOCUMENTS 4,485,566 A * 12/1984 Vivares ..... D06F 58/30 34/547
5,245,764 A * 9/1993 Sung ..... D06F 58/30 34/550
(Continued)

FOREIGN PATENT DOCUMENTS

EP 2182104 5/2010
JP 2010082112 4/2010
(Continued)

OTHER PUBLICATIONS

Extended European Search Report in European Application No. 18206984.9, dated May 14, 2019, 7 pages.

*Primary Examiner* — Edelmira Bosques
*Assistant Examiner* — Bao D Nguyen
(74) *Attorney, Agent, or Firm* — Fish & Richardson P.C.

(57) ABSTRACT

A control method of a dryer according to an embodiment of the present invention in which a heat pump system is provided as a heat source for heating air supplied to a drum includes selecting one of a plurality of operation modes in which initial driving frequencies are different from one another and inputting a drying start command to the dryer by a user; checking an outer temperature and comparing the outer temperature with a preset reference temperature T by a control unit; performing the operation mode selected by the user by the control unit, in a case where the outer temperature is equal to or more than the reference temperature T; performing an operation mode in which the initial driving frequency of the compressor is the highest of the plurality of operation modes, in a case where the outer temperature is less than the reference temperature T.

20 Claims, 4 Drawing Sheets

(51) Int. Cl.
*D06F 58/30* (2020.01)
*D06F 103/50* (2020.01)
*D06F 105/26* (2020.01)

(58) Field of Classification Search
CPC .. D06F 2202/04; D06F 34/00; D06F 2103/00; D06F 2105/00; D06F 2204/06; D06F 2204/10; F25B 49/022
USPC ..... 34/443
See application file for complete search history.

(56) References Cited

U.S. PATENT DOCUMENTS

2005/0066538 A1* 3/2005 Goldberg ..... D06F 25/00 34/218
2005/0199016 A1* 9/2005 Tadano ..... D06F 43/007 68/18 C
2005/0217133 A1* 10/2005 Yakumaru ..... F24F 3/153 34/134
2006/0048404 A1* 3/2006 Tadano ..... D06F 58/24 34/134
2006/0048405 A1* 3/2006 Baek ..... D06F 58/30 34/443
2006/0053651 A1* 3/2006 Tadano ..... D06F 58/206 34/74
2006/0162182 A1* 7/2006 Wong ..... D06F 58/30 34/486
2006/0179681 A1* 8/2006 Tamura ..... F26B 21/086 34/475
2007/0107255 A1* 5/2007 Tamura ..... F25B 9/008 34/475
2007/0145941 A1* 6/2007 Asada ..... D06F 58/206 318/811
2007/0251119 A1* 11/2007 Kim ..... D06F 58/30 34/546
2008/0031756 A1* 2/2008 Hwang ..... F01C 21/0845 418/1
2009/0183385 A1* 7/2009 Lee ..... D06F 58/30 34/497
2010/0077787 A1* 4/2010 Masuda ..... F25B 49/022 62/324.5
2011/0277334 A1* 11/2011 Lee ..... D06F 58/206 34/73
2011/0280736 A1* 11/2011 Lee ..... D06F 58/206 417/26
2011/0289794 A1* 12/2011 Noh ..... D06F 58/206 34/443
2012/0079736 A1* 4/2012 Lee ..... D06F 58/30 34/476
2012/0079737 A1* 4/2012 Lee ..... D06F 58/206 34/487
2012/0144693 A1* 6/2012 Wakizaka ..... D06F 58/30 34/492
2012/0186305 A1* 7/2012 Taniguchi ..... D06F 25/00 68/19
2013/0232813 A1* 9/2013 Heo ..... D06F 58/30 34/515
2013/0340278 A1* 12/2013 Pillot ..... D06F 58/206 34/524
2014/0013614 A1* 1/2014 Choi ..... D06F 58/30 34/480
2014/0033745 A1* 2/2014 Pillot ..... F25B 30/02 62/115
2014/0041249 A1* 2/2014 Jung ..... D06F 58/10 34/282
2014/0060092 A1* 3/2014 Pillot ..... D06F 58/206 62/79
2014/0109436 A1* 4/2014 Noh ..... D06F 58/30 34/499
2014/0298676 A1* 10/2014 Oak ..... D06F 58/30 34/499
2014/0366397 A1* 12/2014 Wakizaka ..... D06F 58/30 34/524
2015/0069933 A1* 3/2015 Ragogna ..... D06F 58/30 318/105
2015/0121718 A1* 5/2015 Huang ..... D06F 58/30 34/476
2015/0322618 A1* 11/2015 Bisaro ..... D06F 58/206 62/79
2016/0002843 A1* 1/2016 Han ..... D06F 58/24 34/427
2016/0047081 A1* 2/2016 Lee ..... D06F 58/206 34/427
2016/0145793 A1* 5/2016 Ryoo ..... D06F 58/206 34/499
2017/0260683 A1* 9/2017 Simon ..... D06F 58/20
2017/0356122 A1* 12/2017 Xu ..... D06F 58/24
2018/0080169 A1* 3/2018 Je ..... D06F 58/20
2018/0142408 A1* 5/2018 Ahn ..... D06F 58/24
2018/0190093 A1* 7/2018 Krula ..... D06F 58/30
2018/0266043 A1* 9/2018 Kim ..... D06F 58/30
2020/0263346 A1* 8/2020 Lee ..... D06F 34/26

FOREIGN PATENT DOCUMENTS

KR 1020050118484 12/2005
KR 1020060014845 2/2006
KR 1020070069025 7/2007
KR 10-2013-0101912 9/2013
KR 1020140094434 7/2014
WO WO2018050012 3/2018

* cited by examiner

CONTROL METHOD OF CLOTHES DRYER

CROSS-REFERENCE TO RELATED APPLICATIONS

The present application claims priority under 35 U.S.C. 119 and 35 U.S.C. 365 to Korean Patent Application No. 10-2017-0154928, filed on Nov. 20, 2017, which is hereby incorporated by reference in its entirety.

FIELD

The present invention relates to a control method of a dryer.

BACKGROUND

In general, a clothes processing apparatus having a drying function such as a washing machine or a dryer is a device for supplying hot air to input wet clothing to evaporate moisture of laundry.

For example, the dryer may include a drum which is rotatably installed in a main body and into which laundry is input, a driving motor which drives the drum, a blowing fan that blows air into the drum, and heating means which heat air which flows into the drum.

Meanwhile, the dryer can be classified into a circulation type dryer and an exhaust type dryer according to a method of discharging hot and humid air. The air that exits the drum has the moisture of the laundry inside the drum and becomes hot and humid air. The circulation type dryer has a system in which hot and humid air is circulated without being discharged to the outside of the dryer and the air is cooled to below the dew point temperature through the heat exchange means to condense the moisture contained in the hot and humid air and re-supplies the air. The exhaust type dryer has a method of directly discharging the hot and humid air through the drum to the outside.

Meanwhile, there may be a heater system which uses high-temperature electrical resistance heat generated by electrical resistance as the heating means, or uses combustion heat generated by burning gas.

Alternatively, the heating means may be a heat pump system. The heat pump system includes a heat exchanger, a compressor, and an expander. The refrigerant circulating through the system heats the air supplied to the drum after collecting the energy of the hot air exhausted from the drum, thereby increasing energy efficiency.

Specifically, the heat pump system has an evaporator on the exhaust side and a condenser on the drum inflow side from the drum, and the heat energy is absorbed by the refrigerant through the evaporator and then heated to high temperature and high pressure by the compressor. Then, the heat energy of the refrigerant is transferred to the air flowing into the drum through the condenser and thus hot air is generated by using the waste energy.

In recent years, dryers to which a heat pump system with high energy efficiency is applied have been actively developed.

Korean Patent Laid-Open Publication No. 10-2013-0101912, which is a related art document, discloses a dryer to which a heat pump system is applied.

Meanwhile, in a case of the dryer to which the heat pump system is applied, when the outer temperature is low, the refrigerant cannot be heated sufficiently, so that the sucked air cannot be heated sufficiently, resulting in a problem that the drying performance of the dryer is greatly deteriorated.

Therefore, it is required to develop a technique capable of improving the heating properties of the air corresponding to the outer temperature.

According to the related art, in a case where the outer temperature is low, the content capable of improving the heating properties corresponding to the outer temperature is not disclosed, so that the drying performance may be deteriorated in a state where the outer temperature is low.

According to the related art, there is provided a high-speed drying mode in which a heater is additionally used as a heat source together with a heat pump system to improve a drying performance. However, since a heater is additionally required, manufacturing cost may greatly increase and power consumption may increase.

Meanwhile, in a case of the dryer using the heat pump system, the capacity of the compressor for compressing the refrigerant to a high temperature serves as an important factor in the performance of the system.

However, since the space inside the dryer is limited, it is limited to increase the size of the compressor to increase the capacity of the capacity. In addition, as the capacity of the compressor increases, the compression performance of the refrigerant is improved, but vibration and noise increase, which can greatly reduce the user product satisfaction. Therefore, it is required to develop a heat pump system capable of exhibiting sufficient performance with less occurrence of vibration.

SUMMARY

An objective of the present invention is to provide a control method of a dryer to which a heat pump system capable of effectively exhibiting drying performance of a dryer in a low-temperature use environment is applied.

An objective of the present invention is to provide a control method of a dryer to which a heat pump system capable of reducing noise and vibration during driving is applied.

A control method of a dryer according to an embodiment of the present invention in which a heat pump system is provided as a heat source for heating air supplied to a drum includes selecting one of a plurality of operation modes in which initial driving frequencies are different from each other and inputting a drying start command to the dryer by a user [S10]; checking an outer temperature and comparing the outer temperature with a preset reference temperature T by a control unit [S20]; performing the operation mode selected by the user by the control unit, in a case where the outer temperature is equal to or more than the reference temperature T [S45]; determining the driving environment of the dryer as a lower temperature state and performing an operation mode in which the initial driving frequency of the compressor is the highest of the plurality of operation modes, in a case where the outer temperature is less than the reference temperature T [S50].

In addition, the plurality of operation modes includes a speed mode in which the initial driving frequency and the variable minimum frequency of the compressor is highest; a standard mode in which the initial driving frequency and the variable minimum frequency of the compressor is lower than the speed mode; and an energy mode in which the initial driving frequency and the variable minimum frequency of the compressor is lower than the standard mode.

In addition, the control method of a dryer includes checking the outlet side temperature of the compressor and comparing the outlet side temperature of the compressor and a preset reference temperature C1 by the control unit [S60];

and determining that the compressor is in an overloaded state and performing a low-speed mode is operated at a variable frequency lower than the variable minimum frequency of the compressor in the operation mode being performed, in a case where the outlet side temperature of the compressor is equal to or more than the reference temperature C1 [S70].

In the low-speed mode, the variable frequency is lower than the variable minimum frequency of the others operation modes of the plurality of the operation modes.

In the low-speed mode, the lowest frequency of the compressor is larger than 0 Hz.

In addition, the control unit releases the low-speed mode and returns to the initial operation mode before the low-speed mode is performed, in a case where the control unit checks that the outlet side temperature of the compressor is less than the reference temperature C1, during performing of the low-speed mode.

In the low-speed mode, the control unit checks the outlet side temperature of the compressor at a predetermined cycle and decreases stepwise the frequency of the compressor by a set frequency reduction value H2.

In addition, the control method of a dryer includes determining whether or not the temperature inside the drum reaches a temperature state which is suitable for drying by comparing the outlet side temperature of the compressor with a preset reference temperature C2 by the control unit, in a state where one of the plurality of operation modes is performed; and decreasing the frequency of the compressor so that the control unit determines that the temperature inside the drum reaches a temperature which is suitable for drying and maintains the temperature, in a case where the outlet side temperature of the compressor is equal to or more than the reference temperature C2.

In addition, the control unit checks whether the outlet side temperature of the compressor is equal to or more than the reference temperature C2 at a predetermined cycle and decreases stepwise the frequency of the compressor by the set frequency reduction value H1, in a state where one of the plurality of operation modes is performed.

In addition, the frequency reduction value H2 is larger than the frequency reduction value H1.

In addition, the compressor is a twin rotary compressor.

In addition, an R134a refrigerant is used as a refrigerant of the heat pump system.

DETAILED DESCRIPTION

Reference will now be made in detail to the embodiments of the present disclosure, examples of which are illustrated in the accompanying drawings.

In the following detailed description of the preferred embodiments, reference is made to the accompanying drawings that form a part hereof, and in which is illustrated by way of illustration specific preferred embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense.

Also, in the description of embodiments, terms such as first, second, A, B, (a), (b) or the like may be used herein when describing components of the present invention. Each of these terminologies is not used to define an essence, order or sequence of a corresponding component but used merely to distinguish the corresponding component from another component(s).

Figure 1:
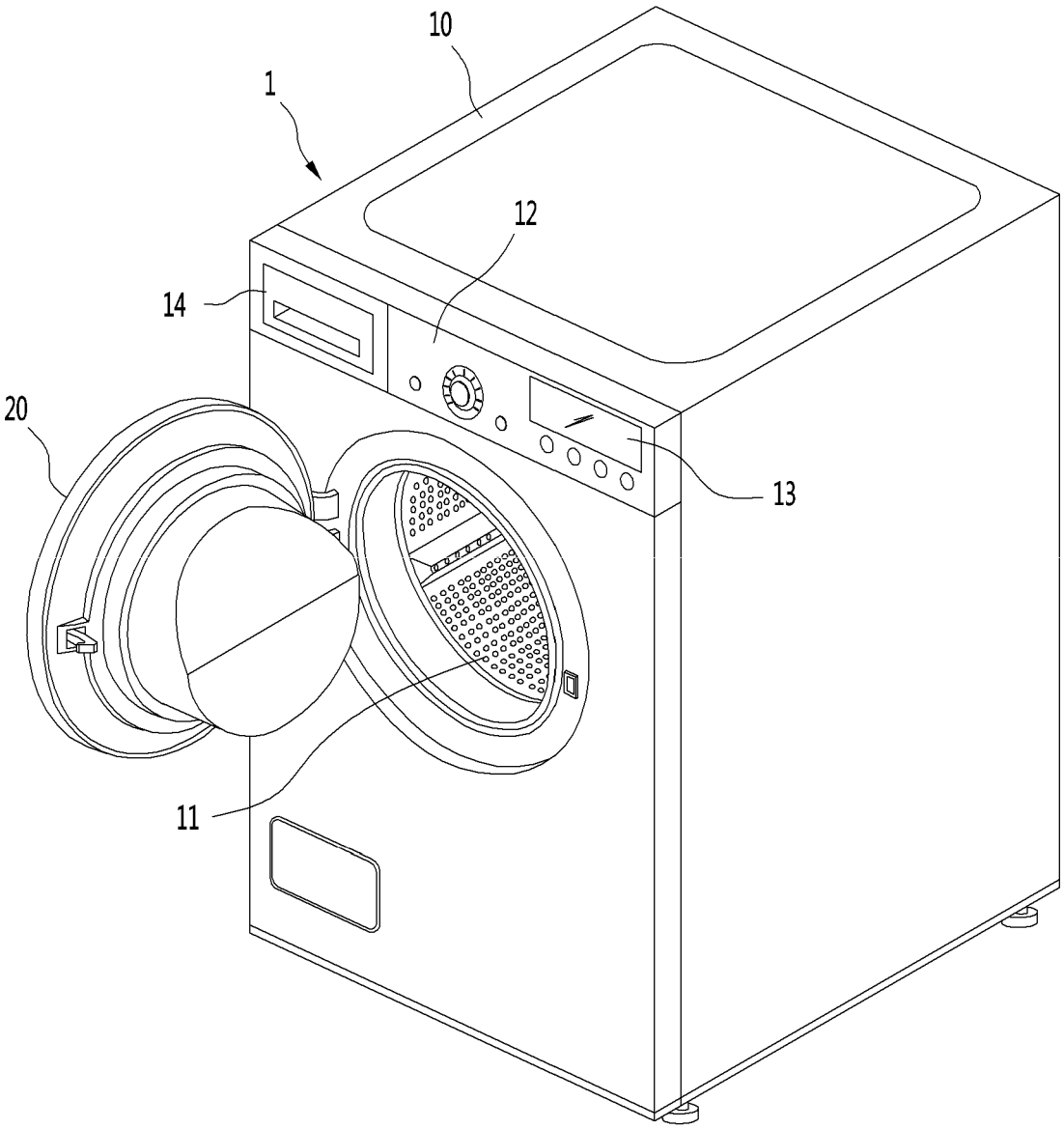
FIG. 1 is a perspective view illustrating a dryer according to an embodiment of the present invention.
Figure 2:
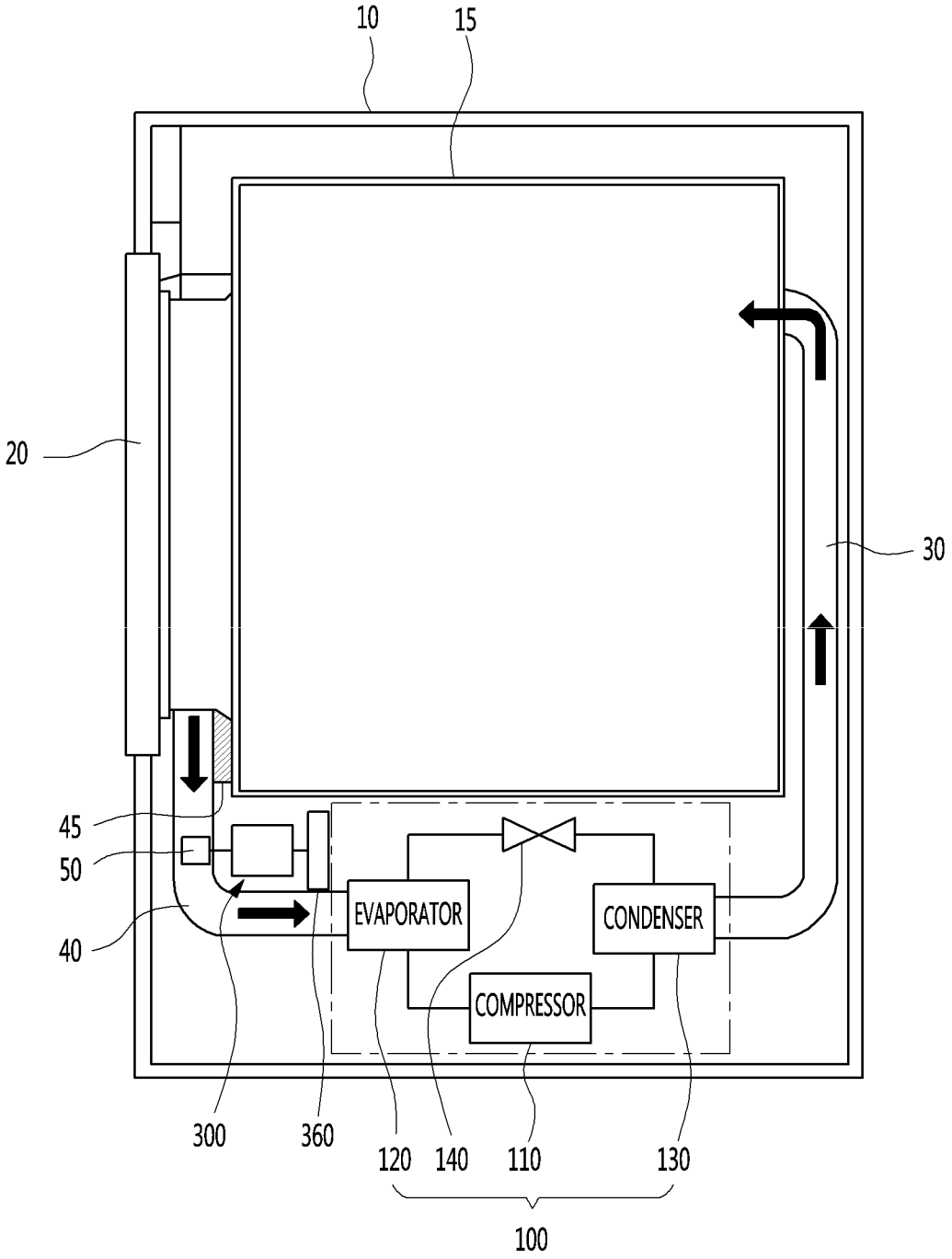
FIG. 2 is a schematic view illustrating an internal configuration of a dryer according to an embodiment of the present invention.
Figure 3:
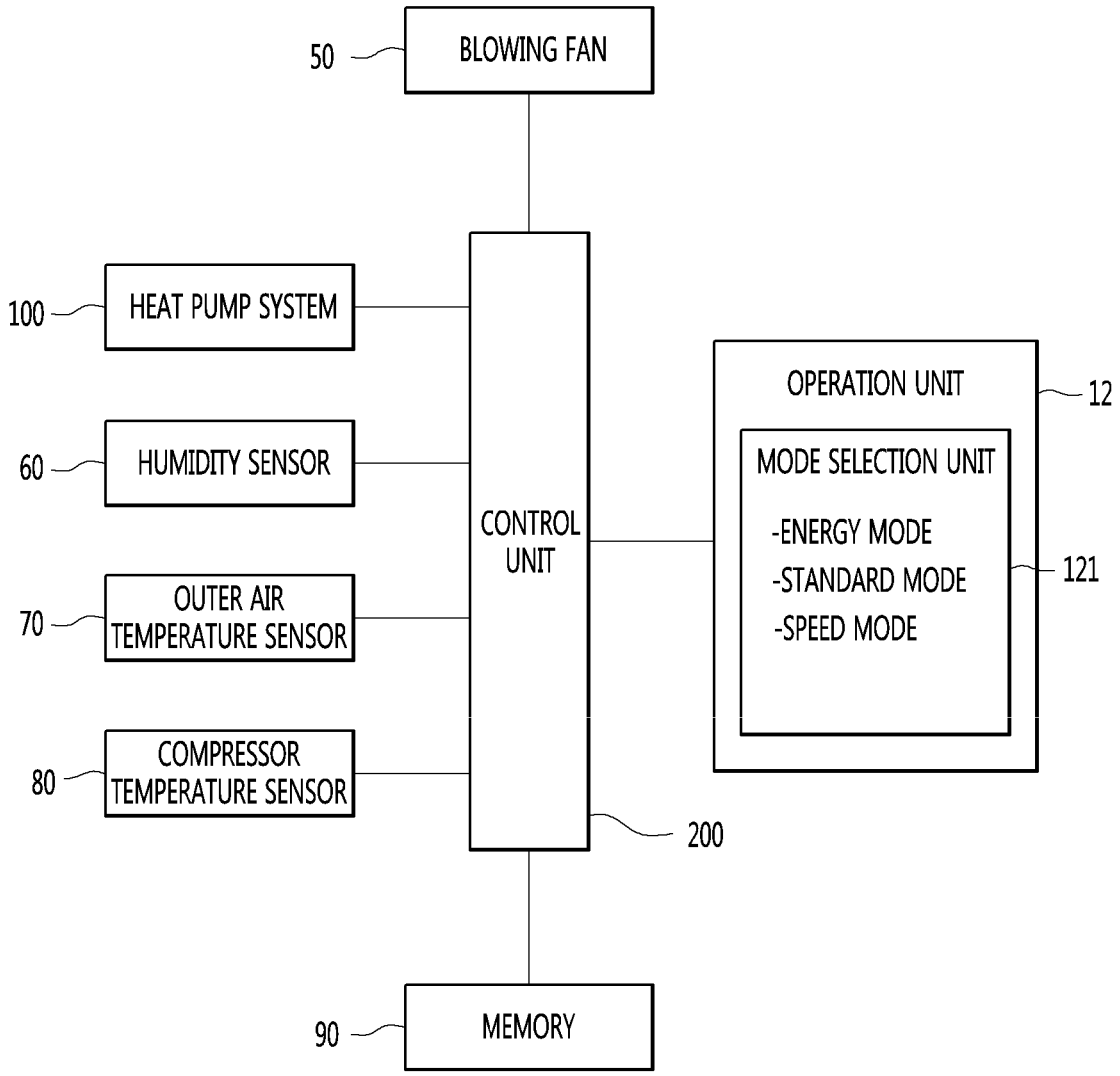
FIG. 3 is a configuration view illustrating a main configuration of a dryer according to an embodiment of the present invention.

FIG. 1 is a perspective view illustrating a dryer according to an embodiment of the present invention, FIG. 2 is a schematic view illustrating an internal configuration of a dryer according to an embodiment of the present invention, and FIG. 3 is a configuration view illustrating a main configuration of a dryer according to an embodiment of the present invention.

A dryer 1 according to an embodiment of the present invention may forms overall an outer appearance by a main body 10 which has an input port 11 for inputting clothes at one side and a door 20 which opens and closes the input port 11.

Inside the main body 10, a drum 15, which is rotatably installed and in which clothes are dried, may be provided. The drum 15 is opened toward the input port 11 and can be provided to allow a user to input clothes into the drum 15 through the input port 11.

The main body 10 may be provided with an operation unit 12 for operating the dryer 1. The operation unit 12 may be located above the input port 11.

The operation unit 12 may be provided with an operation button, a rotary switch, or the like for selecting a function provided to the dryer 1. For example, the user can operate the operation button or the rotary switch provided on the operating unit 12 to turn on or off the power of the dryer 1, input an operation start or drive stop command, and set an operation mode, a drying time, and the like.

The operation unit 12 may further include a display 13. The display 13 may output an operation state of the dryer 1, a set operation mode, time information, and the like.

A drawer 14 may be provided on one side of the main body 10, and liquid or the like to be sprayed onto the drum may be stored inside the drawer 14.

The main body 10 may be provided with a driving motor 300 that provides rotation power to the drum 15. A power transmitting member 360 for rotating the drum 15 is provided on one rotation axis of the driving motor 300 and the drum is connected to the driving motor 300 by the power transmitting member 360 to be capable of receiving power. The power transmitting member 360 may be a pulley or a roller.

The main body 10 may be provided with a supply flow path which supplies air heated to the drum 15 and a duct which forms an exhaust flow path through which the air inside the drum 15 is discharged. The duct may include a supply duct 30 which forms the supply flow path and an exhaust duct 40 which forms the exhaust flow path.

In addition, the main body 10 may be provided with a blowing fan 50 for forcing the flow of air. The blowing fan 50 communicates with the supply duct 30 and the exhaust duct 40 and can force to supply air into the drum 15 through the supply duct 30 and to discharge air in the drum 15 through the discharge duct.

The air blowing fan 50 is provided on the exhaust flow path so that the air discharged from the drum 15 can be sucked into the exhaust duct 40.

The blowing fan 50 may be provided to be connected to the rotation shaft of the driving motor and to rotate simultaneously with the drum 15. Of course, the blowing fan 50 may be connected to a motor separate from the driving motor so as to be rotated independently of the drum 15.

Meanwhile, the embodiments of the present invention will be described with reference to a circulation type dryer in which air in the dryer is circulated, as an example. However, the present invention is not limited to the circulation type dryer and can be applied to an exhaust type dryer.

In a case where the dryer 1 is a circulating type dryer, the exhaust duct 40 may be provided to guide forced air to the supply duct 30.

Meanwhile, in a case where the dryer 1 is an exhaust type dryer, the exhaust duct 40 may be provided to guide the forced air to the outside.

The supply duct 30 may extend to the rear side of the drum 15 and may have a discharge port through which heated air is discharged to the drum at an end portion thereof.

The exhaust duct 40 extends to the front lower side of the drum 15, and a suction port through which the air inside the drum is sucked may be formed at an end portion thereof.

A heater (not illustrated) may be further provided on the supply flow path of the supply duct 30 to heat the supplied air by electric resistance heat. As the heater is provided, the heating properties of the supplied air can be further improved.

A filter 45 may be provided on the exhaust flow path of the exhaust duct 40 to filter foreign matters such as lint contained in the air discharged from the drum 10.

Meanwhile, the main body 10 may be provided with a heat pump system 100 for absorbing waste heat from the air discharged from the drum 15 and heating the air supplied to the inside of the drum 15.

The heat pump system 100 may include an evaporator 120 for cooling the air discharged from the inside of the drum 15, a compressor 110 for compressing the refrigerant, a condenser 130 for heating air supplied in the drum 15, and an expansion valve 140. According to this, the heat pump system 100 may constitute a thermodynamic cycle.

The evaporator 120, the compressor 110, the condenser 130, and the expansion valve 140 may be sequentially connected by piping. The refrigerant can be circulated through the pipe.

The refrigerant may be compressed by the compressor 110 to be in a gaseous state at a high temperature and a high pressure. Then, the refrigerant is in a high-temperature and high-pressure liquid state at the condenser 130 and can perform heat exchange with low-temperature air to be supplied to the drum 15. Then, the refrigerant can be expanded in the expansion valve 140 to become a low-temperature low-pressure gas state. The evaporator 120 can perform heat exchange with the hot and humid air discharged from the drum 15.

The air supplied to the drum 15 can perform heat exchange in the condenser 130 and heated to a high temperature. The hot and humid air discharged from the drum 15 performs heat exchange in the evaporator 120, cooled, remove moisture, and become a dried state. The moisture contained in the hot and humid air can be condensed in the evaporator 120, collected as water, and can be discharged to the outside through a drain pipe (not illustrated).

The evaporator 120 may be provided on an exhaust flow path of the exhaust duct 40. The condenser 130 may be provided on the supply flow path of the supply duct 30.

A machine chamber communicating the exhaust duct 40 and the supply duct 30 with each other may be formed in the main body 10. The compressor 110 and the expansion valve 140 may be provided in the machine chamber. In addition, the driving motor may be also provided in the machine chamber.

Meanwhile, the dryer 1 may further include a control unit 200 which controls the overall operation of the dryer 1 and a memory 90 which stores information such as algorithm data and set value data related to the operation of the dryer 1.

In addition, the dryer 1 may further include an outer air temperature sensor 70 for measuring an outer temperature and a compressor temperature sensor 80 for measuring the temperature of the compressor 110.

The compressor temperature sensor 80 may be provided to measure the outlet side temperature of the compressor 110.

In addition, the dryer 1 may further include a humidity sensor 60. The humidity sensor 60 may be provided to measure the degree of drying of the object to be dried accommodated in the drum 15 or to detect whether or not wet clothes have been input. To this end, the humidity sensor 60 may be provided inside the drum 15.

The operation unit 12, the driving motor, the compressor 110, the memory 90, the outer air temperature sensor 70, the compressor temperature sensor 80, and the humidity sensor 60 may be electrically connected to the control unit 200.

The control unit 200 can detect an operation signal of the operation unit 12 and check information corresponding to the input operation signal from the memory 90. According to the information stored in the memory 90, the operation of the driving motor and the compressor 110 can be controlled. For example, when the drying start command is inputted from the operating unit 12, the control unit 200 drives the driving motor and the compressor 110 to start drying. When the drying termination command is inputted, the driving of the driving motor and the compressor 110 is stopped to terminate the drying.

The control unit 200 may control the operation of the dryer 1 according to information input from the outer air temperature sensor 70, the compressor temperature sensor 80 and the humidity sensor 60.

Specifically, the control unit 200 may control the operation mode of the heat pump system 100 differently based on the temperature input from the outer air temperature sensor 70.

The control unit 200 may switch the operation mode of the heat pump system 100 based on the temperature input from the compressor temperature sensor 80 or control the driving rotational speed of the compressor 110 to control the load. This will be described in more detail with reference to FIG. 4.

The control unit 200 determines whether or not wet clothing is input based on the humidity information input from the humidity sensor 60 and only in a case where the inputting of wet clothing is checked, the driving motor and the compressor 110 can be controlled so as to be operated. Then, the driving of the driving motor and the compressor 110 can be stopped by determining the drying state of the clothes based on the humidity information.

In addition, when the temperature of the inside of the drum 15 reaches a suitable temperature after the compressor 110 is driven, the control unit 200 lowers the rotation speed of the compressor 110 and the inside of the drum 15 be maintained at a temperature suitable for drying.

In this case, the dryer 1 is further provided with a separate temperature sensor for measuring the temperature inside the drum 15, and the control unit 200 can detect the temperature of the inside of the drum 15 through a temperature sensor which measures the temperature inside the drum 15.

Alternatively, the control unit 200 may determine whether or not the temperature inside the drum 15 has reached an appropriate temperature, based on the outlet side temperature of the compressor detected by the compressor temperature sensor 80.

Meanwhile, the compressor 110 may be a twin rotary type compressor. The twin-rotor compressor may have a structure in which two refrigerant compression chambers are vertically formed thereon and two eccentric rollers which are eccentrically rotated by a single drive shaft and compress the refrigerant are installed in the compression chamber so as to have a phase difference of 180 degrees.

The twin rotary compressors have features in which the two eccentric rollers continuously compress refrigerant at the upper and lower portions to improve the compression efficiency of the compressor and reduce vibration and noise.

The compressor 110 can reduce vibrations and noise while providing a higher compression efficiency as compared with a single type compressor having the same volume and only one compression chamber. Accordingly, it is possible to improve the drying performance of the dryer 1 by providing a higher compression efficiency without further consuming a space for accommodating the compressor 110 in the dryer 1.

Meanwhile, the compressor 110 can variably control the driving speed by the control unit 200, and the heating properties of the air can be controlled by varying the driving speed of the compressor 110. In other words, the control unit 200 may vary the operation frequency Hz of the compressor 110.

At this time, as the compressor 110 is applied to a twin rotary compressor, the noise can be reduced in the high-frequency range and the vibration can be reduced in the low-frequency range, as compared with the single type compression. Thus, it is possible to further expand the maximum frequency and the minimum frequency while providing a noise and vibration level that the user is satisfied with.

For example, the frequency driving range of the compressor 110 can be variably controlled from a minimum of 30 Hz to a maximum of 90 Hz.

Meanwhile, as the refrigerant used in the heat pump system 100 R134a can be applied. Of course, various fluids such as R245fa may be used as a refrigerant, but in the embodiment of the present invention, R134a refrigerant is applied as an example.

Since the R134a refrigerant has a high discharge temperature characteristic, it is advantageous to heat the air supplied from the condenser 130 to the drum 15.

Meanwhile, the operation unit 12 may be provided with a mode selection unit 121 for selecting an operation mode of the dryer 1 as an energy mode, a standard mode, and a speed mode.

The energy mode is a mode for reducing power consumption, and the initial driving frequency of the compressor 110 may be the lowest mode among the operation modes.

The standard mode may be a mode in which the initial driving frequency of the compressor 110 is higher than the energy mode and lower than the speed mode.

The speed mode is a mode for maximizing the drying performance of the dryer 1, and the initial driving frequency of the compressor 110 may be higher than the standard mode.

For example, in a case where the dryer 1 is operated in the energy mode, the compressor 110 may be initially accelerated to 50 Hz. In a case where the compressor 110 is operated in the standard mode, the compressor 110 may be accelerated to an initial speed of 75 Hz. In a case where the compressor 110 is operated in the speed mode, the compressor 110 may be initially accelerated to 90 Hz.

Meanwhile, the energy mode, the spin mode, and the speed mode may have variable frequency sections of the compressor 110, respectively.

The compressor 110 can be controlled so that the frequency is lowered to maintain the temperature inside the drum 15 when the temperature inside the drum 15 reaches a suitable temperature for drying.

At this time, the control unit 200 can determine whether or not the temperature inside the drum 15 has reached the suitable temperature based on the temperature measured by the compressor temperature sensor 80.

For example, the control unit 200 may determine that the temperature inside the drum 15 has reached a suitable temperature when the temperature measured by the compressor temperature sensor 80 is 85 degrees. At this time, the temperature inside the drum 15 may be different according to the operation mode, and the speed mode may be the highest and the energy mode may be the lowest.

Meanwhile, the minimum frequency of the compressor 110 in the speed mode may be higher than the minimum frequency of the compressor 110 in the standard mode. The minimum frequency of the compressor 110 in the energy mode may be lower than the minimum frequency of the compressor 110 in the standard mode.

In other words, the energy mode may be a mode in which the maximum frequency and the minimum frequency of the compressor 110 among the operation modes are the lowest. The speed mode may be a mode in which the maximum frequency and the minimum frequency of the compressor 110 are the highest among the operation modes.

For example, the frequency variable range of the compressor 110 in the energy mode may be 50 Hz-35 Hz. The frequency variable range of the compressor 110 in the standard mode may be 75 Hz-48 Hz. The frequency variable range of the compressor 110 in the speed mode may be 90 Hz-60 Hz.

The user can select one of the energy mode, the standard mode, and the speed mode by operating the operation unit 12. For example, in a case where the power consumption is to be reduced, the energy mode can be selected, and in a case where the rapid drying is desired, the speed mode can be selected.

The control unit 200 may control the heat pump system 100 differently according to the operation mode selected by the user.

Meanwhile, in a case where the outer temperature is lower than the predetermined temperature, the control unit 200 may determine as the low-temperature state and ignore the operation mode selected by the user and control the dryer 1 to operate in the speed mode.

Meanwhile, when it is determined that the compressor 110 is overheated, the control unit 200 may switch the dryer 1 to the low-speed mode to prevent the compressor 110 from being damaged.

The low-speed mode may be defined as a mode in which the frequency of the compressor 110 is lower than the minimum frequency of the current operation mode.

For example, in a case where the compressor 110 is operated in the speed mode, the frequency of the compressor 110 may be controlled to be lower than 60 Hz, which is the minimum frequency of the speed mode when the low-speed mode is performed. In a case where the compressor 110 is operating in the energy mode, the frequency of the compressor 110 may be controlled to be lower than 35 Hz, which is the minimum frequency of the energy mode, when the low-speed mode is performed.

In the low-speed mode, the frequency of the compressor 110 may be lower than 35 Hz, which is the minimum frequency of the energy mode. For example, the frequency of the compressor can be lowered to at least 30 Hz.

Meanwhile, when the low-speed mode is performed, the frequency of the compressor 110 may be controlled so as to be stepwise reduced to 30 Hz which is the minimum frequency of the low-speed mode of the compressor 110. Alternatively, it may be controlled so as to immediately decelerate to 30 Hz, which is the minimum frequency of the low-speed mode, and then maintain the minimum frequency.

Hereinafter, a control method of the dryer 1 according to an embodiment of the present invention will be described in detail with reference to the drawings.

Figure 4:
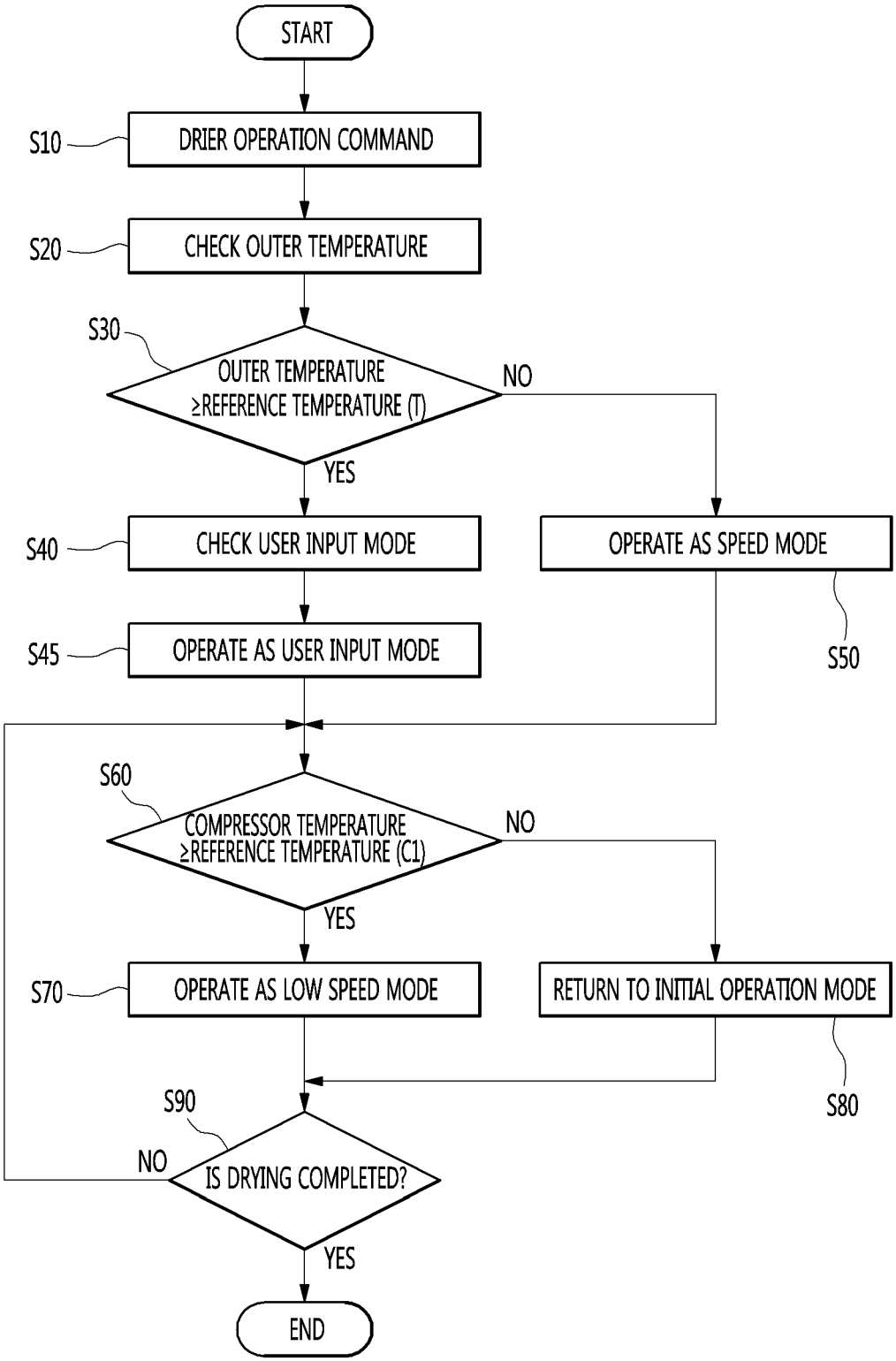
FIG. 4 is a flowchart of a control method of the dryer 1 according to the embodiment of the present invention.

FIG. 4 is a flowchart of a control method of the dryer 1 according to the embodiment of the present invention.

A user can input an operation command to the dryer 1 by operating the operation unit 12. At this time, the user can select one of the energy mode, the standard mode, and the speed mode through the operation of the operation unit 12 [S10].

When the operation command is input to the dryer 1, the control unit 200 can check the outer temperature. The outer temperature can be measured at the outer air temperature sensor 70. The measured outer temperature may be transmitted to the control unit 200. Accordingly, the control unit 200 can detect the outer temperature [S20].

The control unit 200 may compare the detected outer temperature with a reference temperature T, which is a preset temperature value. In detail, the control unit 200 may determine whether or not the detected outer temperature is equal to or more than, or less than the reference temperature T. The reference temperature T may be stored in the memory 90 and provided.

The reference temperature T may be a temperature lower than 10 degrees and may be set to, for example, 5° C. [S30].

In a case where the outer temperature is equal to or more than the reference temperature T, the control unit 200 can check the operation mode selected by the user. In other words, one of the energy mode, the standard mode, and the speed mode which is selected by the user can be checked [S40].

In a case where the outer temperature is equal to or more than the reference temperature T, the control unit 200 can determine as the room temperature and operate the dryer 1 in the operation mode selected by the user.

For example, in a case where the user selects the energy mode, the compressor 110 may be initially accelerated to 50 Hz to drive the heat pump system 100. Then, the blowing fan 50 and the drum 15 are operated to allow drying with low power consumption.

In a case where the user selects the standard mode, the compressor 110 may be initially accelerated to 75 Hz to drive the heat pump system 100. Then, the blowing fan 50 and the drum 15 can be operated to perform drying.

In a case where the user selects the speed mode, the compressor 110 may be initially accelerated to 90 Hz to drive the heat pump system 100. In addition, the blowing fan 50 and the drum 15 can be operated to increase the heating properties of the air supplied to the drum 15. According to this, drying can be performed rapidly.

Meanwhile, when it is determined that the internal temperature of the drum 15 has reached the suitable temperature for drying, the control unit 200 may lower stepwise the frequency of the compressor 110 to a predetermined level.

At this time, the control unit 200 compares the temperature measured by the compressor temperature sensor 80 with a preset reference temperature C2 and when the temperature measured by the compressor temperature sensor 80 reaches a reference temperature C2, can be determined that the inside of the drum 15 has reached the suitable temperature. For example, the reference temperature C2 may be 85 degrees.

The control unit 200 continuously checks the temperature measured by the compressor temperature sensor 80 at a predetermined cycle and lowers the frequency of the compressor 110 by a frequency reduction value H1 selected for each when the temperature reaches the reference temperature C2.

At this time, the set frequency reduction value H1 may be 1 Hz.

In the energy mode, the frequency of the compressor 110 may be lowered to 35 Hz. In the standard mode, the frequency of the compressor 110 may be lowered to 48 Hz. In the speed mode, the frequency of the compressor 110 may be lowered to 60 Hz [S45].

On the other hand, in a case where the outer temperature is lower than the reference temperature T, the control unit 200 may determine the driving environment of the dryer 1 as a low-temperature condition. Accordingly, the control unit 200 can operate the dryer 1 in the speed mode while ignoring the operation mode selected by the user. In other words, in a case where the outer temperature is equal to or less than the reference temperature T, the dryer 1 can be operated in the speed mode even if the energy mode and the standard mode are selected by the user.

At this time, the control unit 200 may initially accelerate the compressor 110 to 90 Hz to drive the heat pump system 100. The drying operation can be rapidly performed by operating the blowing fan 50 and the drum 15 so as to increase the heating properties of air supplied to the drum 15.

As in step S45, if the control unit determines that the internal temperature of the drum 15 has reached the suitable temperature for drying, the control unit 200 can decrease stepwise the frequency of the compressor 110 to a predetermined level [S50].

Meanwhile, when the compressor 110 is overheated, the compressor 110 may be damaged.

In order to prevent this, the control unit 200 may determine whether the temperature of the compressor 110 is overheated.

The control unit 200 may determine the overheated state of the compressor 110 through the surface temperature of the compressor 110 and in this case, a separate temperature sensor for measuring the surface temperature of the compressor 110 is further provided.

Alternatively, the control unit 200 may determine the overheating state of the compressor 110 through the outlet side temperature of the compressor 110 detected by the compressor temperature sensor 80.

Hereinafter, for example, a case where the control unit 200 determines whether or not the compressor 110 is heated or overheated based on the outlet side temperature of the compressor 110 will be described.

The control unit 200 can compare the temperature detected by the compressor temperature sensor 80 with the reference temperature C1 which is a preset temperature value and determine whether or not the outlet side temperature of the compressor 110 is equal to or more than, or less than the reference temperature C1.

The reference temperature C1 may be stored in the memory 90 and provided and may be a temperature value higher than the reference temperature C2. For example, the reference temperature C1 may be set to 95 degrees [S60].

In a case where the outlet side temperature of the compressor 110 is equal to or more than the reference temperature C1, the control unit 200 may perform a low-speed mode to prevent damage to the compressor 110 due to overheating.

As described above, the low-speed mode may be defined as a mode of operating the frequency of the compressor 110 to be less than the minimum frequency of the current operation mode.

When the low-speed mode is performed, the frequency of the compressor 110 may be controlled to be stepwise reduced to 30 Hz, which is the minimum frequency of the low-speed mode of the compressor 110. Alternatively, the frequency of the compressor may be controlled to immediately decelerate to 30 Hz, which is the minimum frequency of the low-speed mode, and then maintain the minimum frequency.

In a case where the frequency of the compressor 110 is controlled to decrease stepwise, the control unit 200 can continuously check the outlet side temperature of the compressor 110 at a predetermined cycle. In a case where the outlet side temperature of the compressor 110 is equal to or more than the reference temperature C2, the frequency of the compressor 110 may be lowered by a set frequency reduction value H2. At this time, the set frequency reduction value H2 may be 5 Hz [S70].

Meanwhile, in a case where the outlet side temperature of the compressor 110 is less than the reference temperature C1, the control unit 200 can control the dryer 1 to continuously operate in the initial operation mode in which the dryer 1 is in operation. The initial operation mode may be one of the energy mode, the standard mode, and the speed mode, as an operation mode at the time of driving state of the dryer 1.

In addition, the control unit 200 can continuously check the outlet side temperature of the compressor 110 even after the low-speed mode is performed. When the outlet side temperature of the compressor 110 decreases below the reference temperature C1, the control unit 200 allows the dryer 1 to be released from the low-speed mode and to be returned to the initial operation mode before the low-speed mode is performed [S80].

The control unit 200 may stop the driving of the drum 15 and the compressor 110 when the drying of the input cloth is completed [S90].

In the dryer 1 according to the embodiment of the present invention described above, the following effects can be expected.

First, when the outer temperature is less than the reference temperature T, the control unit determines that the operating environment of the dryer is in a low-temperature, ignores the operation mode selected by the user, forcibly performs the operation mode in which the initial driving frequency of the compressor of the plurality of operation modes. Therefore, in a situation where the outer temperature is low, the heat pump system can achieve sufficient heating properties, thereby preventing an excessive drying time from being generated. Therefore, it is possible to prevent the generation of the user complaints about the performance of the dryer.

Second, the control unit checks the outlet side temperature of the compressor, and in a case where the outlet side temperature of the compressor is more than the reference temperature C1, the control unit determines that the compressor is overloaded and performs the low-speed mode. At this time, since the low-speed mode decelerates the compressor to a frequency less than the variable minimum frequency of the compressor in the operation mode being performed, the load of the compressor is reduced. Thus, the compressor can be prevented from being damaged by the high temperature.

Third, the lowest frequency of the compressor in the low-speed mode is larger than 0 Hz. In other words, the compressor is operated at a low-speed in a state where the compressor is overloaded, so that the air can be continuously heated. Therefore, drying performance can be improved.

Fourth, in the low-speed mode, the control unit checks the outlet side temperature of the compressor at a constant cycle and decreases stepwise the outlet side temperature of the compressor. Therefore, the compressor is rapidly cooled, the heating properties are prevented from being lowered, and the optimum performance can be achieved while reducing the load.

Fifth, as compressors are applied as twin rotary compressors, vibration and noise at high and low frequencies can be minimized. Thus, the maximum frequency and minimum frequency range of the compressor can be expanded while maintaining vibration and noise levels at customer satisfaction levels. Therefore, it is possible to further secure a frequency range of the low-speed mode in which the lowest frequency is less than the operation mode. In addition, since the maximum frequency can increase, the drying performance can be further improved.

What is claimed is:

1. A control method of a dryer that includes a main body that defines an input port, a drum rotatably installed in the main body, a driving motor configured to provide rotation power to the drum, a fan configured to cause flow of air to the drum, a heat pump system configured to heat air supplied to the drum, a control unit configured to control operation of the dryer, and the heat pump system including a condenser, an evaporator, and a compressor, the control method comprising:

receiving a selection of an operation mode among a plurality of operation modes, the plurality of operation modes corresponding to a plurality of initial driving frequencies of the compressor that are different from one another;

comparing an outer temperature detected by an outer air temperature sensor to a reference temperature;

based on the outer temperature being greater than or equal to the reference temperature, determining that a driving environment of the dryer corresponds to a room temperature environment;

based on a determination that the driving environment of the dryer corresponds to the room temperature environment, performing the selected operation mode;

based on the outer temperature being less than the reference temperature, determining that the driving environment of the dryer corresponds to a low temperature environment; and based on a determination that the driving environment of the dryer corresponds to the low temperature environment, performing a first mode among the plurality of operation modes, the first mode corresponding to a highest initial driving frequency among the plurality of initial driving frequencies of the compressor.

2. The control method according to claim 1, wherein the plurality of operation modes further correspond to a plurality of operation frequencies of the compressor, each operation frequency having a range between a minimum frequency and a maximum frequency, and wherein the control method further comprises:

comparing an outlet side temperature of the compressor to a first reference temperature, the outlet side temperature being detected by a compressor temperature sensor;

based on the outlet side temperature of the compressor being greater than or equal to the first reference temperature, determining that the compressor is in an overloaded state; and based on a determination that the compressor is in the overloaded state, performing a low-speed mode by operating the compressor at an operation frequency that is less than a minimum operation frequency corresponding to the selected operation mode.

3. The control method according to claim 2, wherein the plurality of operation modes further comprises a speed mode, a standard mode, and an energy mode, and wherein the control method further comprises:

operating, in the speed mode, the compressor at the highest initial driving frequency and at the minimum operation frequency;

operating, in the standard mode, the compressor at a standard initial driving frequency less than the highest initial driving frequency and at a standard operation frequency less than the minimum operation frequency; and operating, in the energy mode, the compressor at an energy initial driving frequency less than the standard initial driving frequency and at an energy operation frequency less than the standard operation frequency.

4. The control method according to claim 2, wherein performing the low-speed mode comprises operating the compressor at an operation frequency that is less than any other minimum operation frequency corresponding to the plurality of operation modes.

5. The control method according to claim 4, wherein performing the low-speed mode further comprises operating the compressor at an operation frequency that is greater than zero Hz.

6. The control method according to claim 2, further comprising:

based on a detection of the outlet side temperature of the compressor being less than the first reference temperature during performance of the low-speed mode, switching from the low-speed mode to the selected operation mode.

7. The control method according to claim 2, further comprising:

during performance of the low-speed mode, detecting, at a first detection cycle, the outlet side temperature of the compressor; and based on the outlet side temperature detected at the first detection cycle, decreasing the operation frequency of the compressor stepwise by a first frequency reduction value.

8. The control method according to claim 7, further comprising:

comparing the outlet side temperature of the compressor to a second reference temperature in a state in which one of the plurality of operation modes is performed;

based on a comparison result of the outlet side temperature to the second reference temperature, determining whether a temperature inside the drum corresponds to a target temperature range;

based on the outlet side temperature of the compressor being greater than or equal to the second reference temperature, determining that the temperature inside the drum corresponds to the target temperature range; and based on a determination that the temperature inside the drum corresponds to the target temperature range, decreasing the operation frequency of the compressor to maintain the temperature inside the drum within the target temperature range.

9. The control method according to claim 8, further comprising:

detecting, at a second detection cycle, the outlet side temperature of the compressor in a state in which one of the plurality of operation modes is performed;

determining whether the outlet side temperature detected at the second detection cycle is greater than or equal to the second reference temperature; and based on a determination that the outlet side temperature detected at the second detection cycle is greater than or equal to the second reference temperature, decreasing the operation frequency of the compressor stepwise by a second frequency reduction value.

10. The control method according to claim 9, wherein the first frequency reduction value is greater than the second frequency reduction value.

11. The control method according to claim 1, further comprising:

determining a drying state of laundry based on humidity information detected by a humidity sensor; and based on a determination that the drying state of laundry corresponds to completion of drying, stopping driving the drum and the compressor.

12. The control method according to claim 11, further comprising:

based on a determination that the drying state of laundry does not correspond to completion of drying, comparing an outlet side temperature of the compressor to a first reference temperature, the outlet side temperature being detected by a compressor temperature sensor.

13. The control method according to claim 1, wherein the compressor comprises a twin rotary compressor.

14. The control method according to claim 1, wherein the heat pump system is configured to receive an R134a refrigerant.

15. The control method according to claim 1, wherein the dryer further includes:

a supply duct configured to communicate with the fan and to guide heated air to the drum, the supply duct defining a supply flow path; and a discharge duct configured to communicate with the fan and to guide suctioned air from the drum, the discharge duct defining a discharge flow path, wherein the condenser is located at the supply flow path, and wherein the evaporator is located at the discharge flow.

16. The control method according to claim 1, further comprising:

based on reception of the selection of the operation mode, detecting the outer temperature by the outer air temperature sensor.

17. A dryer comprising:

a main body that defines an input port configured to receive laundry;

a drum rotatably installed in the main body;

a driving motor configured to provide rotation power to the drum;

a fan configured to cause flow of air to the drum;

a heat pump system configured to heat air and to supply heated air to the drum, the heat pump system comprising a condenser, an evaporator, and a compressor;

an outer air temperature sensor configured to detect an outer air temperature outside of the dryer; and a control unit configured to control operation of the dryer, wherein the control unit is configured to:

receive a selection of an operation mode among a plurality of operation modes, the plurality of operation modes corresponding to a plurality of initial driving frequencies of the compressor that are different from one another, compare the outer air temperature to a reference temperature, based on the outer air temperature being greater than or equal to the reference temperature, determine that a driving environment of the dryer corresponds to a room temperature environment, based on a determination that the driving environment corresponds to the room temperature environment, perform the selected operation mode;

based on the outer air temperature being less than the reference temperature, determine that the driving environment of the dryer corresponds to a low temperature environment, and based on a determination that the driving environment corresponds to the low temperature environment, perform a first mode among the plurality of operation modes, the first mode corresponding to a highest initial driving frequency among the plurality of initial driving frequencies of the compressor.

18. The dryer according to claim 17, further comprising a compressor temperature sensor configured to detect an outlet side temperature of the compressor, wherein the plurality of operation modes further correspond to a plurality of operation frequencies of the compressor, each operation frequency having a range between a minimum frequency and a maximum frequency, and wherein the control unit is further configured to:

compare the outlet side temperature of the compressor to a first reference temperature;

based on the outlet side temperature of the compressor being greater than or equal to the first reference temperature, determine that the compressor is in an overloaded state; and based on a determination that the compressor is in the overloaded state, perform a low-speed mode by operating the compressor at an operation frequency that is less than a minimum operation frequency corresponding to the selected operation mode.

19. The dryer according to claim 18, wherein the plurality of operation modes further comprises a speed mode, a standard mode, and an energy mode, and wherein the control unit is further configured to:

operate, in the speed mode, the compressor at the highest initial driving frequency and at the minimum operation frequency;

operate, in the standard mode, the compressor at a standard initial driving frequency less than the highest initial driving frequency and at a standard operation frequency less than the minimum operation frequency; and operate, in the energy mode, the compressor at an energy initial driving frequency less than the standard initial driving frequency and at an energy operation frequency less than the standard operation frequency.

20. The dryer according to claim 18, wherein the control unit is further configured to, in the low-speed mode, operate the compressor at an operation frequency that is less than any other minimum operation frequency corresponding to the plurality of operation modes.

* * * * *